US005645368A

United States Patent [19]

Yunick

[11] Patent Number: 5,645,368

[45] Date of Patent: Jul. 8, 1997

[54] RACE TRACK WITH NOVEL CRASH BARRIER AND METHOD

[76] Inventor: Henry Yunick, 957 N. Beach, Daytona Beach, Fla. 32117

[21] Appl. No.: 654,793

[22] Filed: May 29, 1996

Related U.S. Application Data

[63] Continuation of Ser. No. 303,386, Sep. 9, 1994, abandoned.

[51] Int. Cl.[6] ..... E01F 15/08; E01F 15/10

[52] U.S. Cl. ..... 404/6; 404/7; 256/13.1; 472/85; 472/89

[58] Field of Search ..... 404/6, 7, 9, 101, 404/1, 71; 256/1, 13.1; 472/85, 88, 89, 86, 87; 273/246; D21/141, 143, 240

[56] References Cited

U.S. PATENT DOCUMENTS

| | | | |
|---|---|---|---|
| D. 204,468 | 4/1966 | Smedley | D21/143 |
| D. 302,032 | 7/1989 | Kamikawa | D21/143 |
| 1,149,623 | 8/1915 | Bramley | 472/85 |
| 3,848,853 | 11/1974 | Way et al. | 256/1 |
| 4,186,913 | 2/1980 | Bruner et al. | 256/1 |
| 4,452,431 | 6/1984 | Stephens et al. | 404/6 X |
| 4,557,466 | 12/1985 | Zucker | 256/13.1 |
| 4,681,302 | 7/1987 | Thompson | 404/6 |
| 4,880,083 | 11/1989 | Thompson . | |
| 5,152,632 | 10/1992 | Hawkes | 404/71 X |
| 5,387,049 | 2/1995 | Duckett | 404/6 |
| 5,464,177 | 11/1995 | Kramer et al. | 404/11 X |

*Primary Examiner*—James Lisehora

*Attorney, Agent, or Firm*—Watts, Hoffmann, Fisher & Heinke Co., L.P.A.

[57] ABSTRACT

A race track is disclosed having a tri-oval banked, racing surface surrounded by a barrier support material delineating a race barrier support surface at a level below the racing surface. A plurality of barrier modules are mounted on the support surface in longitudinally aligned relationship to delineate two crash barrier rings circumscribing the racing surface. Each of the modules includes a base mounted on the barrier support surface with the inner ring in juxtaposed relationship with the racing surface. Each base includes a top surface substantially in elevational alignment with a perimetral portion of the racing surface. Each module includes a vehicle impact energy absorbing means mounted on and connected to its base for cushioning energy absorption upon impact by an out of control race vehicle; and, each module base and a portion of the barrier support material upon which that module is mounted together forming a further vehicle energy absorbing means. A method of conducting vehicle racing contests is also disclosed. The method includes constructing a plurality of race tracks of substantially equal configurations dimensionally, conducting racing events with vehicles each equipped with power trains and tires respectively constructed to a set of specifications such that competing vehicles have substantially equal performance capabilities, determining the relative position of each competing vehicle at the conclusion of each event, assigning values to the vehicles recording to the position determinations, and, utilizing the assigned values to determine an overall winner of a series of events.

30 Claims, 7 Drawing Sheets

RACE TRACK WITH NOVEL CRASH BARRIER AND METHOD

This is a continuation of application Ser. No. 08/303,386, filed on Sep. 9, 1994, now abandoned.

TECHNICAL FIELD

This invention relates to vehicle race tracks and more particularly to vehicle race tracks equipped with novel and improved crash barriers and to a method of operating racing events.

BACKGROUND OF THE INVENTION

Existing automobile closed circuit racetracks have been individually designed and constructed, such that no two tracks are totally alike. One thing virtually all such tracks have had in common is perimetral rigid crash barriers designed to protect spectators and other persons near a track but not those participating in the actual operation of vehicles on the track, be it for practice, racing or time trials. While these crash barriers function quite well to protect persons other than the drivers of the race vehicles, race vehicle impact with such a barrier all too often proves fatal. Indeed, a study of records of forty years of automobile races revealed that in excess of ninety percent of the fatal accidents originated with a vehicle impacting a crash barrier.

Other unsafe conditions which exist at race tracks include spectators are permitted around pit areas at many tracks, which of itself creates danger. The spectators may be injured by being struck by a moving vehicle or movement of various parts and equipments around the pit area. In addition, pedestrians have been known to crowd around the pits, making it difficult and dangerous for pit crews to perform their duties and responsibilities.

Existing tracks are also unsafe when wet. Present track surfaces and tires result in very dangerous conditions if the track gets wet, since, among other problems, there is virtually no resistance to lateral sliding movement of a race vehicle on a wet track. In addition, no provision is made for detecting, other than by an operator's observance, unsafe conditions such as failing tires, as a failure develops.

Existing tracks provide only minimal services and equipment for the race teams themselves. As a consequence many race teams have equipment vans which carry maintenance and repair equipment for servicing race vehicles at racing facilities. In addition, the racing team often must provide fuel cans for transporting fuel to pit service areas, where the fuel is poured into gravity feed fueling arrangements. The crews also carry bottles of compressed air, since compressed air seldom is available in the pits and otherwise racing teams must provide virtually everything needed to service and maintain the racing vehicles.

Existing conditions and rules permit very well financed teams to dominate racing. The provision of mobile repair vans is but one small example. Often a special high powered short lived engine is used to qualify a vehicle and a long lived race engine is then substituted for a race. Very sophisticated electronic devices are used to fine tune the vehicles to adjust and trim various vehicle components. In addition, very well financed teams have been known to utilize different engine types for different races operated under different sets of rules, such as special engines for the Indianapolis 500 and then different engines for other races run by the same Indianapolis type cars during a racing season.

Thus, there is a need for a greater uniformity in the tracks themselves and their operation as well as track supplied equipment in order to give skills of the drivers and their crews renewed importance. In addition, there is a need for far greater safety and for consistency and uniformity in race tracks and the governing rules more effectively to compare the results from different racing locations. Satisfaction of these needs would enable highly skilled teams without superior financing capabilities effectively to compete.

SUMMARY OF THE INVENTION

In order to provide more uniform competition a new racing organization will be formed which, under current plans, will be known as the American Racing League (ARL). A number of identical race tracks, preferably sixteen, will be built. The League will conduct races with vehicles of two racing levels. The vehicles will be stock cars with the vehicles of the two levels being virtually identical except for permitted engine size and power.

Each track will be a 1½ mile tri-oval, concrete track banked throughout its length from a minimum of approximately 5½° with the horizontal to a maximum of approximately 15° on four identical turns. The League will conduct two races for each level of vehicles at each of its sixteen race locations for a total of thirty-two for a season to determine an overall champion. The actual number of tracks, their locations and their rules for operation while initially established as set out here will, once the League is fully established, be controlled by franchisees. Initially there will be thirty-four car franchisees with twenty-five of these car franchisees entitled automatically to repeat in a succeeding season if they finish in the top twenty-five for a given racing season.

The preferred track is seventy feet in width. On the curves the track preferably has an inner section of approximately 23⅓ feet in width banked to 12°, a central section of equal width banked to 13°, and an outer section also of equal width banked to 14°.

The track racing surface is surrounded by a safety ring which is forty feet in transverse dimension. In the preferred embodiment two rings of end to end crash barrier modules are mounted on the safety ring around the racing surface. The inner barrier ring is juxtaposed against the racing surface while the outer ring surrounds the inner ring in spaced relationship.

The crash barrier modules are designed to withstand the maximum impact of a vehicle being raced. For example, if stock cars are racing the barrier will yieldably absorb a 150 mile per hour head on collision while subjecting the driver to a maximum of 100 g's of force for no longer than 5 milliseconds, and thereafter no more than 50 g's of force for no more than 100 milliseconds. In short, the crash barriers absorb the force of such a crash in a manner which will permit a healthy driver to survive, recognizing that the amount of impact a human body can withstand is a function of both the level of the force and the time over which a body is subjected to that force.

The preferred barrier module has a base of about sixteen feet by about four feet in dimension upon which four layers of vehicle tires are stacked in front and back rows. The tires are stacked in a fashion that resembles a brickwork with, for example, a tire in a row of the second layer straddling the juncture of two tires in the row of the layer below it and tires in the third layer axially aligned with the first layer so that each overlies one half of two adjacent tires of the second layer.

The barrier base is preferably steel and is preferably a steel grate with a honeycomb like configuration. A steel grate is especially preferred when a sand or gravel undersurface is provided to enhance resistance to the barrier modules being moved away from the track upon impact. If desired the weight of the barrier is increased by the addition of weight such as bags of sand or water.

The second or outer ring of barrier modules are also staggered such that the center of a module in the outer ring, longitudinally speaking, is transversely aligned with the juncture of two modules in the inner ring. The spacing between the rings and the weight of modules is adjusted according to the mass of the vehicles competing on the raceway and the speeds which they are capable of attaining. Thus, for example, the crash barriers are adjusted space wise and weight wise differently for a race of Indianapolis type cars than a race of stock cars. The appropriate barrier configuration for a given race is a function of the weight of the racing vehicles and their anticipated top speeds. Barrier variables including (1) mass of the barriers, (2) coefficient of friction between the barriers and the selected safety ring surface material or materials, (3) slope of the safety ring surface from 0° to 10°, and (4) spacing of the rings, are all taken into account in determining an appropriate crash barrier configuration for a given race.

Pit areas and a garage for storage and repair of race vehicles are provided in an infield within each racing oval. Each garage is fully equipped so that competitors can repair and service their vehicles. Air under pressure is supplied to each pit location and each such location is supplied with a fuel pump and tank, so that precisely measured quantities of fuel can be delivered to each such fuel tank and thence to a race vehicle. Accordingly, the need for air bottles and fuel cans is eliminated. Similarly, under the rules for racing in either of the two classes of vehicles of the new organization, the fuel will be a standard commercially purchased gasoline.

For further control of the fuel and assurance of the permitted amount of fuel, no more and no less, being available for use by each race team, the vehicle fuel tanks and their connecting hoses are supplied by the track operators. For further safety fueling nozzles are each coupled to the fuel hose coming from its fuel pump by a quick release coupling to avoid a fuel spill in the event that a race car is inadvertently and prematurely driven away from a pit area as it is being fueled.

Another safety feature of the improved race track is the provision of a segment of the racing surface which straddles a start/finish line in the form of a window. The window permits conditions of tires to be inspected as vehicles pass over it to identify defective tires and warn vehicle operators before tire failures cause accidents. The window can also be used for automatically keeping track of the number of laps which each competitor has completed and, in the event of a "photo finish", determining a winner.

To assure competitiveness, reduce the cost of racing and further enhance safety each of the competitive cars is to a very large degree standardized. The cars are equipped with uniform suspension systems and with air jacks to minimize potential dangers caused by wheeling around manual jacks and accidents caused by long jack handles projecting from jacks positioned under vehicles. Engine heads and manifolds are provided by the league to be sure of uniformity. Very careful electronically controlled inspections of vehicles are made to be sure that piston sizes, displacements and the like are all within the uniform standards established by the League. Noise levels are reduced through the utilization of mufflers.

Tires are uniform all weather tires enabling the vehicles to race rain or shine. Racing in rain is safely accomplished both by the provision of tires appropriate for such racing and through provision of the concrete raceway, rather than asphalt or other more slippery surface.

A main grandstand positioned along a straightaway is connected to the infield by a tunnel that preferably runs under the start/finish line. The tunnel affords pedestrians the ability to pass safely from the grandstand to the infield while viewing race vehicles through the surface window as they pass overhead.

An elevated spectator viewing area which is readily accessible from the tunnel is provided adjacent the pits. Spectators can safely observe pit activity from the viewing area but are kept fully segregated from the cars and pit crews further to enhance safety.

Both of the League race stock car classes use stock bodies with standardized suspensions, plastic nose and tail pieces and have a standard wheel base. Rules require that the same engine used for qualifying for a race is used for that race further preventing the well financed teams having an advantage money can buy, namely using a very high powered short lived engine for qualifying while a longer lived engine is used for the actual race.

Safe operation on the tracks is strictly enforced and fines are levied for rule violations. If a rule violation has resulted in damage to another competitor's car, or injury to the driver, the levied fine is given to such injured driver or the operator of the damaged vehicle.

Accordingly, the objects of the invention are to provide a novel and improved racetrack including a novel and improved crash barrier and a method of operating racing event.

IN THE DRAWINGS

DETAILED DESCRIPTION

The Track

Figure 1:
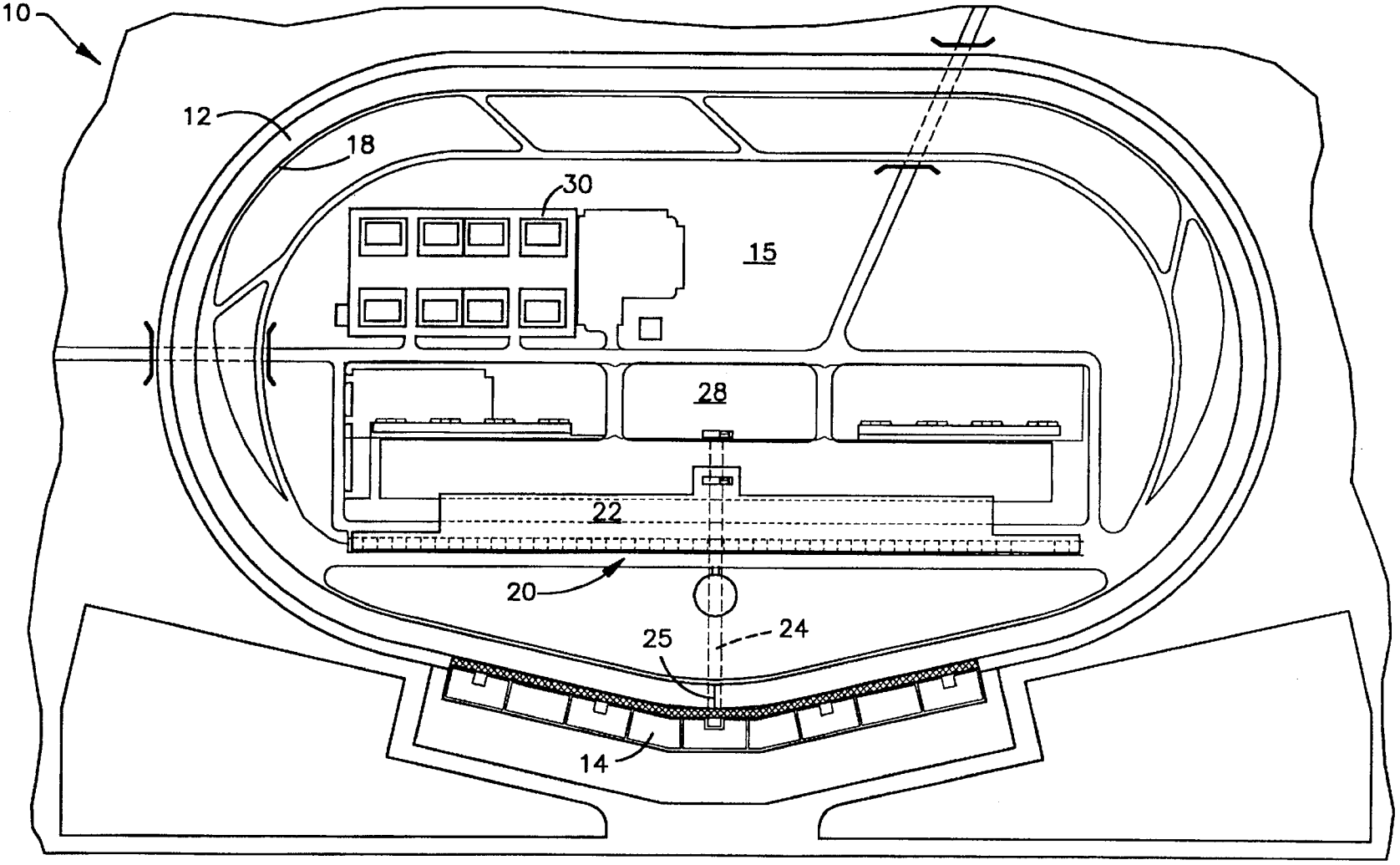
FIG. 1 is a plan view of the race facility of this invention.
Figure 2:
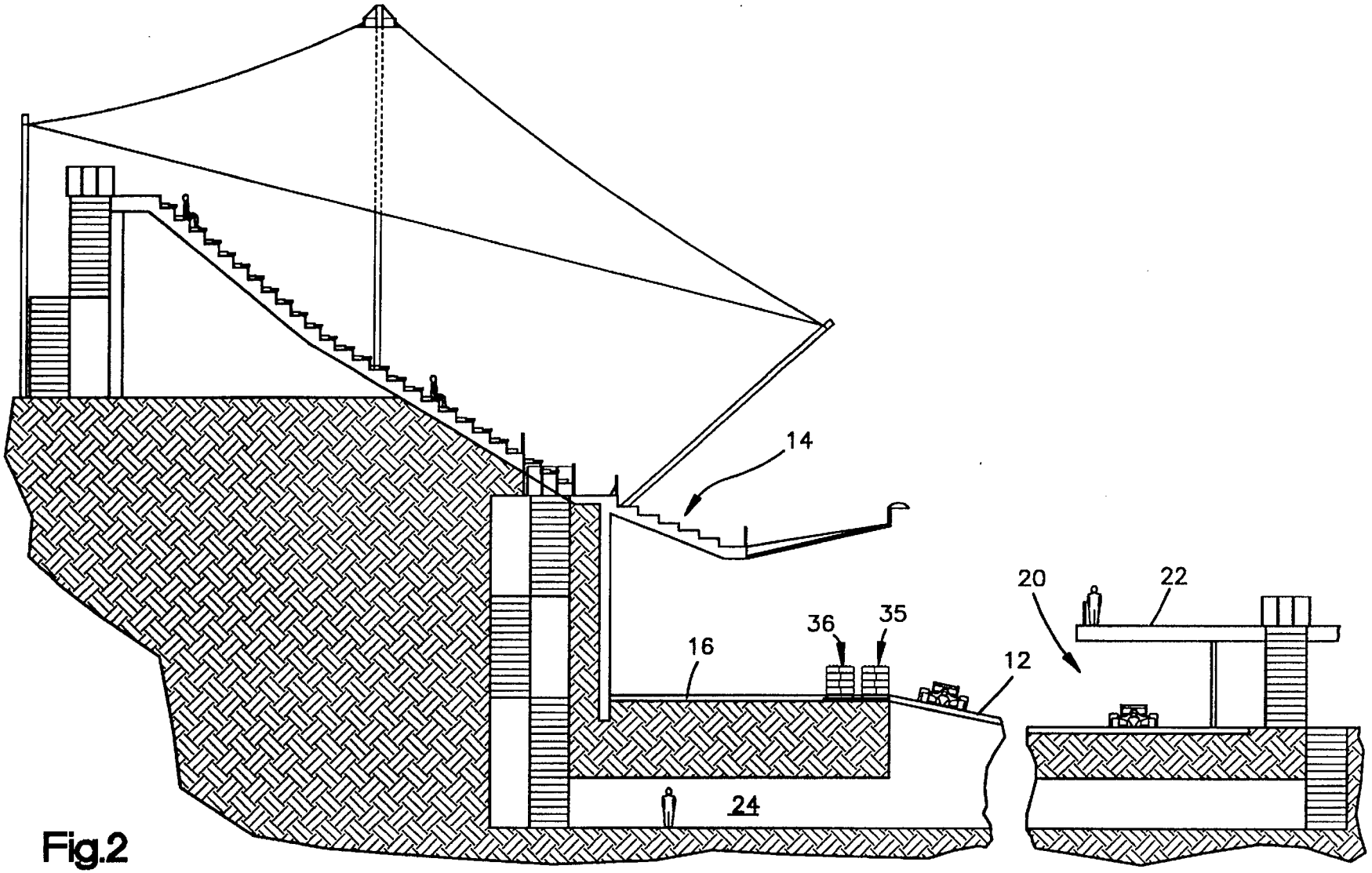
FIG. 2 is a partially sectioned and foreshortened elevational view, on an enlarged scale, of a section of the racetrack of FIG. 1 showing the grandstand, a spectator viewing area and a tunnel interconnecting the grandstand and the viewing area.

Referring to the drawings and initially to FIGS. 1 and 2 in particular, a race facility is shown generally at 10. The facility 10 includes an oval raceway 12 of so called tri-oval configuration. The raceway 12 is of concrete for enhanced life and traction. The raceway is preferably approximately seventy feet in transverse dimension.

A grandstand 14 is provided for viewing events on the raceway 12. The grandstand overlooks not only the raceway 12 but an infield 15 surrounded by the raceway. The raceway 12 is circumscribed by an adjacent safety ring 16 which is also forty feet in transverse dimension. The usual apron 18 is within and communicates with the raceway 12.

The infield 15 includes a pit area shown generally at 20. A novel and improved spectator structure 22 is constructed adjacent and over the pit area to provide an area from which spectators may view activities in the pit area while assuring the spectators are safely segregated from the pit crews and the activities in the pit area.

Figure 6:
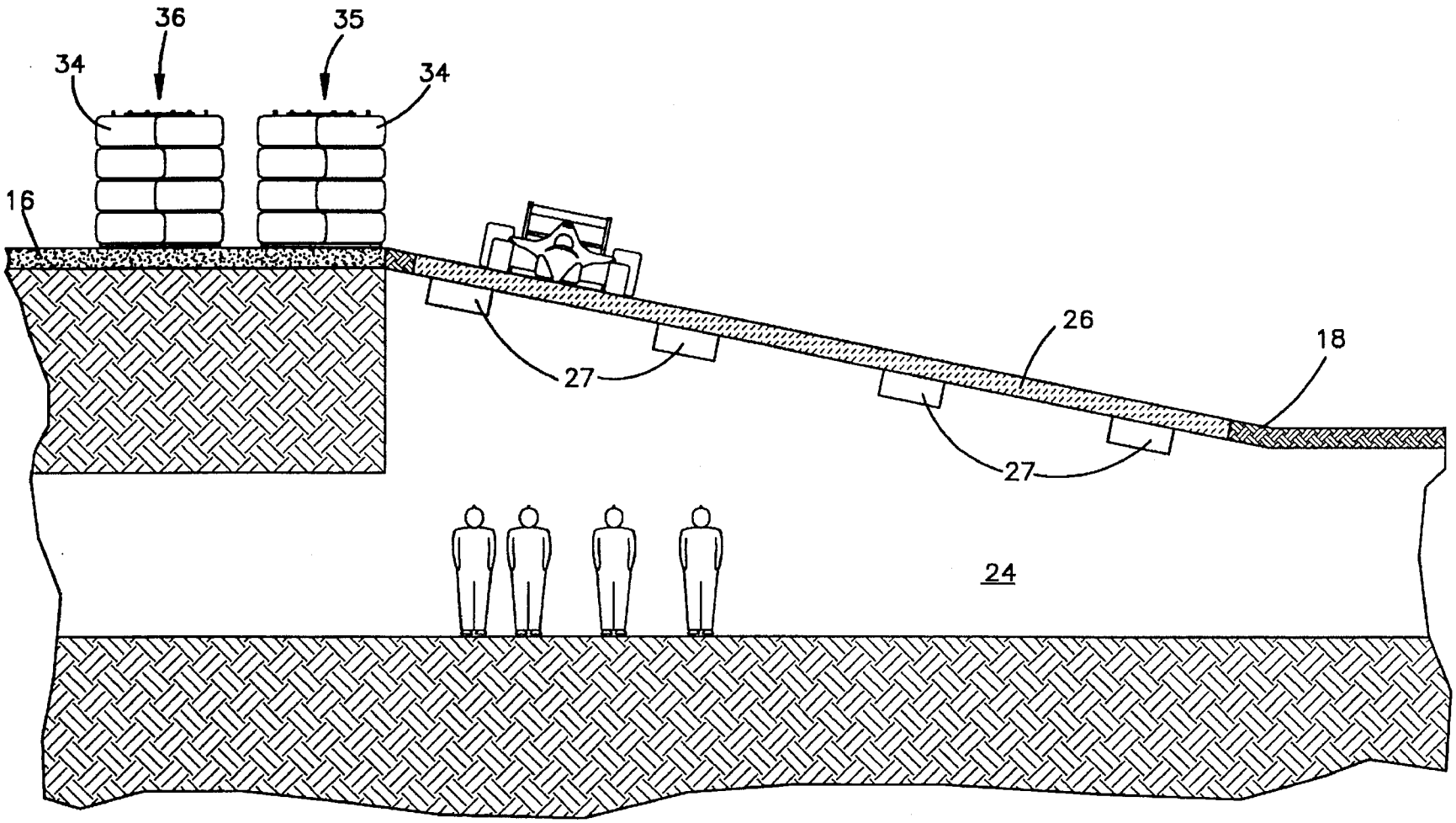

A tunnel 24 interconnects the grandstand and the viewing structure 22. The tunnel 24 passes directly under a start/finish line 25. The start/finish line 25 is atop and straddled by a window 26 (FIG. 6) which permits spectators in the tunnel 24 to see the undersides of vehicles passing overhead. More importantly detection mechanisms indicated schematically at 27 are provided for the purpose of detecting tire defects in order that the vehicle drivers can be warned if they have defective tires. The detection mechanisms 27 can also function to keep accurate lap counts of contestants in a race being operated on the raceway 12 and to determine a winner, especially if there is a so called "photo finish".

Shopping facilities 28 are provided in the infield 15. Spectator access to the shopping facilities 28 from either the grandstand 14 or the viewing structure 22 is provided through the tunnel 24. A garage 30 is provided in the infield. The garage 30 is ample to house the vehicles present for an anticipated race. The garage is fully equipped with all equipment required of a race team to repair and maintain the vehicles.

The Crash Barrier Modules

Figure 3:
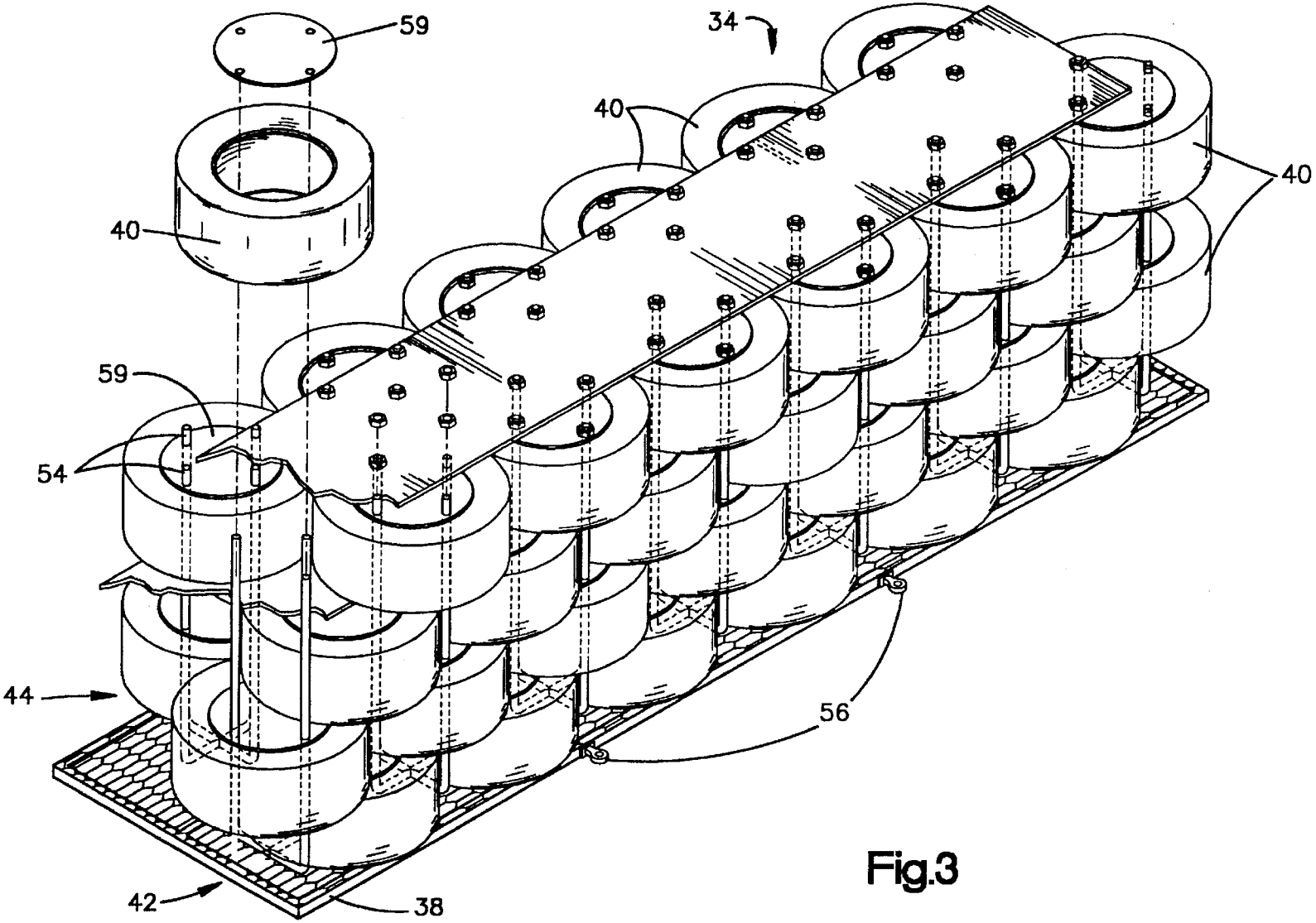
FIG. 3 is a perspective view with parts broken away and removed of a crash barrier module of this invention on an enlarged scale with respect to FIGS. 1 and 2.
Figure 4:
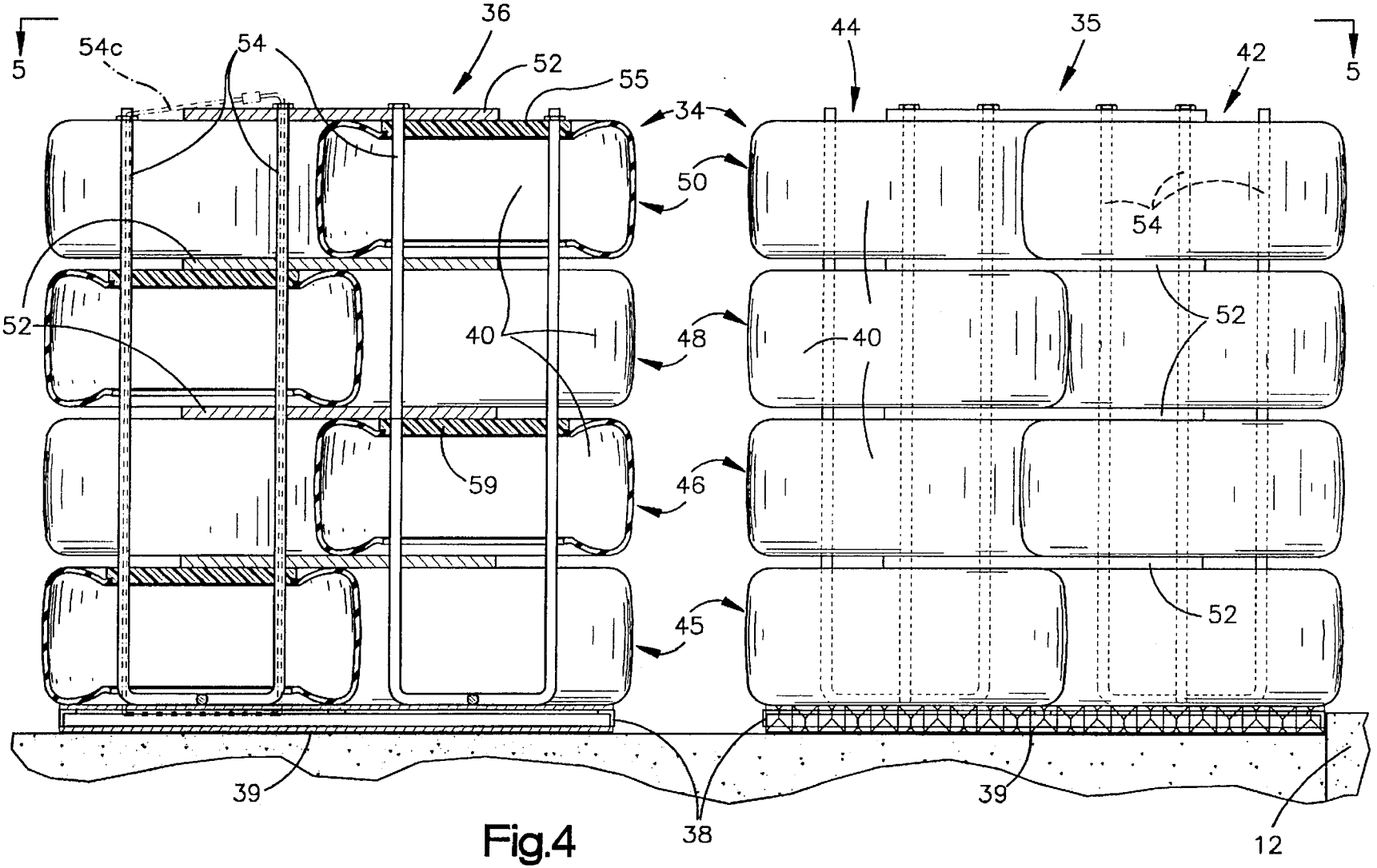
FIG. 4 is an end elevational view, with parts shown in section, of the inner and outer rings of the novel and improved crash modules of this invention.
Figure 4A:
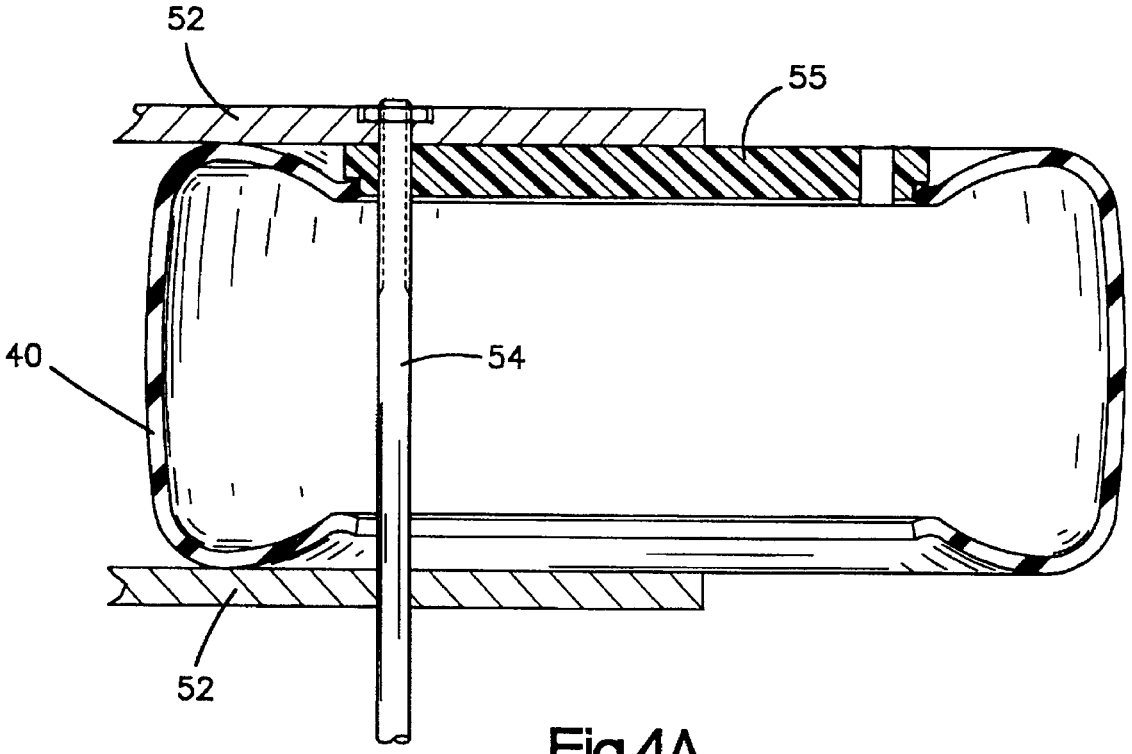
FIG. 4A is an enlarged sectional view of a segment of a module including one of the tires.
Figure 5:
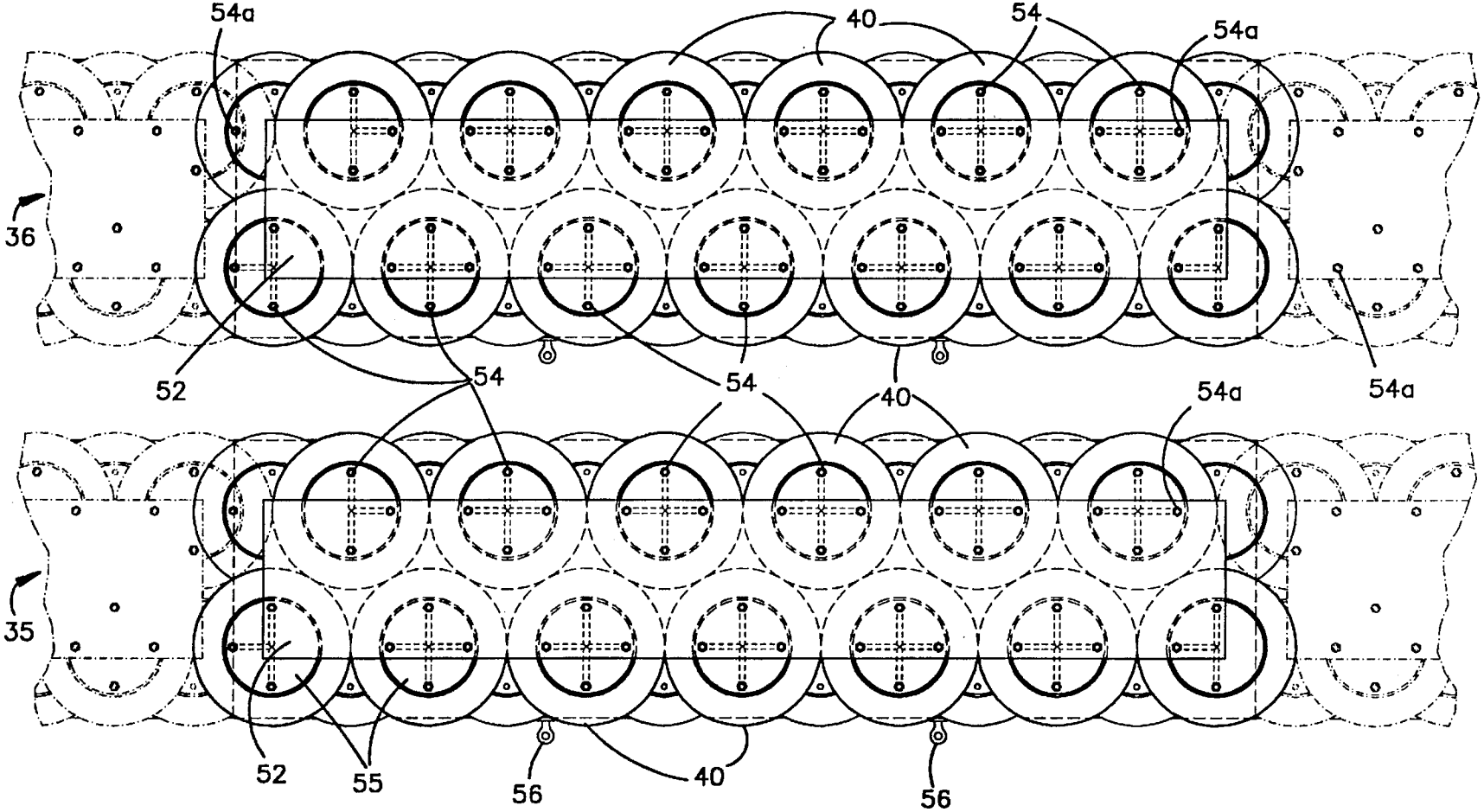
FIG. 5 is a top plan view of segments of the two rings as seen from the plane indicated by the line 5—5 of FIG. 4; and, FIG. 6 is an enlarged sectional view of the track and tunnel at the start/finish line.

A plurality of crash barrier modules 34 are provided, FIGS. 3, 4 and 4A. While the modules 34 are shown and described as used in conjunction with the disclosed and preferred track, they are suitable for use with any vehicle racetrack. The modules shown are in the form which have been constructed as prototypes.

The modules are aligned in juxtaposed end to end relationship to form inner and outer rings 35, 36 which surround the raceway. The inner ring 35 is juxtaposed against the raceway in close relationship, while the outer ring 36 circumscribes the inner ring 35 in spaced relationship. The spacing between the rings 35, 36 is determined and adjusted according to the mass of the vehicles which will compete in a given race event and the anticipated top speeds of those vehicles.

Each of the crash modules 34 includes a rectangular base 38. The base 38 in its preferred form is sixteen feet in length and four feet, four inches in width. Temporary modules used to replace an impacted module as a race is progressing are made slightly shorter to facilitate quick restoration of the barrier. The base 38 is formed of steel either as a solid plate (left hand barrier in FIG. 4) or alternatively of a grate (FIG. 3 and the right hand barrier in FIG. 4) having the mesh like form shown in FIG. 3. Whether equipped with a base of solid steel or a grate, the base has a bottom slide surface 39 for barrier supporting engagement with a supporting surface.

A plurality of tires 40 are mounted on the base. The tires are mounted in front and rear rows 42, 44. Each row has lower, second, third and top layers 45, 46, 48, 50. The tires of each row are in juxtaposed relationship projecting slightly outwardly of the base 38 to provide initial impact energy absorption upon impact by an out of control vehicle. The tires of the front row 42 of each layer are offset longitudinally from the tires of the back row 44, such that a vertical transverse plane including the axis of a tire in the front row will intersect the juncture of two adjacent tires in the rear row 44. Similarly, the tires of successive layers are alternately staggered. Thus, the hypothetical plane that includes the axis of a tire in the lower layer 45 will intersection the juncture of two adjacent tires in the second layer 46 and in the top layer 50 while also including the axis of a tire in the third layer 48. Expressed another way the tires collectively are oriented in the nature of a brickwork with tires in the lower and third layers being aligned vertically and each offset half a tire width from adjacent tires in the second and top layers.

Spacer sheets 52 are plywood in the prototype and likely will be of other materials in production versions. The sheets 52 are interposed between successive layers vertically and positioned over the top of the four layers of tires in each module to rigidify the modules.

Tires of the second and top layers 46, 50 of the front rows 42 at the ends of the modules extend into adjacent modules. These end tires are inserted after the adjacent modules have been positioned next to one another. Similarly end tires of the lower and third layers 45, 48 of the back row 44 are inserted after the modules are juxtaposed and project between the base 38 and a sheet 42 or between two sheets 42 of both of the juxtaposed modules.

Tie downs in the form of rods 54 in the prototypes and it is anticipated, cables 54*c* (FIG. 4 left module) in production versions are provided. The tie downs 54 extend from the base 38 upwardly through the layers of tires in each row through the top sheet 52 to fix the entire crash module together. The rods 54*a* for the end tires are inserted only after the modules are juxtaposed and the end tires are inserted. Only one such rod 54*a* is passed through each of these end tires that project into two modules to prevent each such tire from coming loose on impact but to allow juxtaposed modules to separate on impact. The rods also extend through tire positioning discs 55 each of which is nested against and project into the bead of an associated tire to form a water tight seal. Pull elements 56 are connected to the bases 38 so that each module can be pulled into place such as by a tractor.

The modules 34 of the inner ring 35 are positioned, as seen in FIG. 4, against the raceway 12 with the top of each base 38 horizontally aligned with the surface of the raceway. Modules of the outer ring 36 are spaced from the inner ring 35 a distance appropriate for energy absorption of vehicles competing in a given racing event. All of the modules 34 are supported on the so called "safety ring" 16 which is preferably sand or gravel but may be, according to the application of the modules and the vehicles to be racing, concrete, asphalt or a combination of any two, three of or four three materials.

The modules and the material of the safety ring are designed and selected so that the driver of a vehicle experiencing a "worst case" collision with the crash barrier will survive. Similarly, the surface of the safety ring ranges from flat to an upward slope, outward from the track, of up to 10° to accommodate a "worst case" collision. Each barrier module as it absorbs an impact will slide over the surface of the safety ring until an aligned module or modules of the outer ring are impacted and ultimately the vehicle is brought to rest hopefully clear of the raceway, thus enhancing the safety for other participants in a race.

According to published data, a human body can withstand up to 100 times the force of gravity (one g) for up to 5 milliseconds and 50 g's for 100 milliseconds. If a 3,500 pound stock car vehicle hits a module of the crash barrier head on at 150 mph, the barrier must travel at least 1 foot within 5 milliseconds and the vehicle will be slowed from its 150 mph, 220 feet per second rate to 204 feet per second with a decelerating force of less than 375,000 pounds. In the ensuing 100 milliseconds at a maximum of 50 g's, the car is slowed from 204 to 60 feet per second and travels an additional 13 feet. Continued barrier motion absorbs the remaining velocity at far lower g force to bring the vehicle safely to a stop off the active raceway without fatal injury to, or entrapment of, the driver.

Operation of the Track

Once the racetrack facility 10 has been constructed and an event is scheduled, the two rings of modules 35, 36 are positioned to circumscribe the track. After each pair of adjacent modules 34 has been positioned in side by side relationship, the four tires bridging the two modules are manually inserted and rods 54*a* are dropped through the spacer sheets 52, the discs 55 and the in the manually inserted tires. The rods 54*a* are then threaded into fasteners provided on the base 38. Only one rod is positioned in each of these tires for the purpose of preventing the manually inserted tires being thrust from the modules on vehicle impact, but since but one rod is used nonetheless permitting the modules to separate upon vehicle impact.

Assuming the race to be conducted is a stock car race, the modules selected and positioned will be of the type shown in the drawings, or production equivalents as previously described. A race will then be conducted with stock cars constructed according to ARL specifications, each having the same wheel base, identical tires and engines including racetrack or league supplied manifolds and heads. In addition, fuel tanks and connecting tubing and fuel will have been supplied by the track.

As the race proceeds, tires, and if desired other operating conditions of the vehicles, are observed by the detector 27 through the window 26. If unsafe conditions such as a developing tire failure are detected, the driver and/or the crew of the vehicle having the defect are advised in order that the vehicle can be brought into the pits for repair before there is a failure.

In the event of impact with the inner ring 35 the of crash barrier modules, the impacted module or modules will be driven outwardly over the surface 16. If the impact is severe the impacted modules of the inner ring will be driven outwardly into one or more modules of the outer ring 36. As the out of control vehicle is brought to rest, it will be positioned substantially, if not completely, off the raceway 12 thus avoiding interference with the other race vehicles and hopefully the crashed vehicle still will be repairable to a raceable condition. In addition, after such a collision normally the driver will have sustained only minor, if any, injuries.

Following such a vehicle impact of the crash barrier, the vehicle is removed and the barrier ring is restored to a raceway circumscribing condition. Since such an impact will normally displace more than one of the modules, quick restoration with appropriate positioning of impacted modules may be difficult due to their close juxtaposed relationship prior to impact. Accordingly, to facilitate quick repair of the ring to enable a prompt return to full speed racing, repair modules of shorter longitudinal dimension are provided. With an appropriate mechanical assist, such as with a fork lift truck, an impacted module can be removed and one of the repair modules can be quickly inserted in its place.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A crash barrier module for inhibiting departure of a motor vehicle from an intended route of travel over a vehicle travel surface, the barrier module comprising:

a) a base including a top surface for surface extension alignment with the travel surface;

b) an impact absorbent structure including a plurality of discrete, stacked components mounted on and fixed to the base for energy absorption upon impact by a vehicle and for concurrent transfer of impact produced forces to the base;

c) the base including a bottom slide surface for frictional resistance to movement over a barrier support surface adjacent to the travel surface, such movement occurring upon vehicle impact with the module; and, d) the energy absorption capacity of the module including energy absorbed by the structure being adequate normally to avoid a vehicle operator fatality by absorbing the energy of a worst condition impact by a vehicle of a type intended to traverse the travel surface.

2. A crash barrier module for absorbing impact energy upon impact by an out of control race motor vehicle comprising:

a) a rectangular base having a top surface for horizontal alignment with a racing surface of a vehicle race track;

b) the base including skid resistant elements for engagement with a support surface, the skid elements providing frictional resistance during sliding movement of the module over such support surface following impact of the module by a race vehicle;

c) a plurality of vehicle tires supported by and connected to the base;

d) the tires being arranged in at least two rows;

e) each of the rows including a plurality of tire layers with the tires of each layer being longitudinally offset with the tires of each contiguous layer;

f) the tires of at least one of the layers in one row being longitudinally offset with the tires of at least one of the layers of an adjacent row; and, g) said at least one layers being at a common elevational level relative to the base when the module is in use.

3. The module of claim 2 wherein a plurality of layer dividing sheets are provided and wherein when the module is in use at least one of said sheets is between two elevationally contiguous layers of at least two rows to separate the elevationally contiguous layers and provide support for an upper one of the elevationally contiguous layers.

4. The module of claim 3 wherein the sheets are plywood.

5. The module of claim 3 wherein the tire to base connections are provided by tie elements each extending through at least one tire of each layer of each row and the sheets, the tie elements being anchored in the base.

6. The module of claim 5 wherein the tie elements are cables.

7. In combination a plurality of the modules of claim 2 and a motor vehicle race track having such a travel surface, the modules being in longitudinally aligned relationship along a marginal portion of at least a section of the perimeter of the track travel surface.

8. The combination of claim 7 wherein the modules form a ring circumscribing the track travel surface.

9. The combination of claim 8 wherein there are inner and outer module rings with the inner ring circumscribing the track travel surface and the outer ring circumscribing the inner ring in closely spaced relationship whereby on severe vehicle impact with a barrier module of the inner ring the impacted module will be slidingly driven into at least one module of the outer ring.

10. A race track comprising:

a) a race vehicle supporting material delineating an endless racing surface;

b) barrier support material delineating a race barrier support surface circumscribing the racing surface at a level below the racing surface;

c) a plurality of barrier modules mounted on the support surface in longitudinally aligned relationship and delineating a crash barrier ring circumscribing the racing surface, at least certain of the modules being free of force transmitting interconnections with adjacent modules such that on impact each of said certain modules is moveable relative to the other modules without transmitting impact forces to adjacent modules;

d) each of the modules including a base mounted on the barrier support surface in juxtaposed relationship with the racing surface, each module including a base having a top surface substantially in elevational alignment with a perimetral portion of the racing surface;

e) each module including a vehicle impact energy absorbing means mounted on and connected to its base for cushioning energy absorption upon impact by an out of control race vehicle; and, f) each base of said certain modules and a portion of the barrier support material upon which that module is mounted together, providing frictional resistance to movement of said certain modules upon module impact by such out of control race vehicle thereby providing frictional energy absorption as such impacted module moves relative to the support material in response to such impact.

11. The track of claim 10 wherein at least one module comprises:

a) the base being rectangular;

b) the energy absorbing means including a plurality of vehicle tires supported by and connected to the base;

c) the tires being arranged in at least two rows;

d) each of the rows including a plurality of tire layers with the tires of each layer being longitudinally offset with the tires of each contiguous layer;

e) the tires of at least one of the layers in one row being longitudinally offset with the tires of at least one of the layers of the other and contiguous row; and, f) said at least one layers being at a common elevational level relative to the base when the module is in use.

12. The track of claim 11 wherein the base includes skid elements along a lower portion of the base for engagement with the support surface, the skid elements being adapted to provide energy absorbing frictional resistance during sliding movement of the module over the support surface following impact of the module by a race vehicle.

13. The track of claim 11 wherein the at least one module includes a plurality of layer dividing sheets and wherein when the module is in use at least one of said sheets is between two elevationally contiguous layers of at least two rows to separate the elevationally contiguous layers and provide support for an upper one of the elevationally contiguous layers.

14. The track of claim 13 wherein the sheets are plywood.

15. The track of claim 13 wherein the tire to base connections are provided by tie elements each extending through at least one tire of each layer of each row and the sheets, the tie elements being anchored in the base.

16. The track of claim 15 wherein the tie elements are cables.

17. The track of claim 10 wherein there are inner and outer barrier module rings with the inner ring circumscribing the track racing surface and the outer ring circumscribing the inner ring in closely spaced relationship whereby on severe vehicle impact with a barrier module of the inner ring the impacted module will be slidingly driven into at least one module of the outer ring.

18. A vehicle race track comprising:

a) paving material defining an oval racing surface of banked configuration;

b) a safety ring circumscribing the racing surface;

c) a ring of moveable crash barrier modules in end to end relationship slidably mounted on the safety ring and substantially juxtaposed with the racing surface; and, d) each of said modules including means permitting movement independent of other of the modules having an inertial resistance to motion selected to provide impact resistance adequate safely to absorb the force of a given impact of a vehicle of a type intended to race on the surface without the operator of such vehicle being a fatality, the given impact having the force equal to an anticipated maximum impact force of such vehicle with one of said modules.

19. The track of claim 18 wherein the paving material is concrete.

20. The track of claim 18 wherein the surface along curves of the oval has inner, central and outer sections wherein as measured transversely of the surface the banked angle with the horizontal of the inner section is the smallest angle, the banked angle of the central section is an intermediate angle and the banked angle of the outer section is the largest angle.

21. The track of claim 20 wherein the smallest, intermediate and largest angles are about 12°, 13° and 14° respectively.

22. A crash barrier module for absorbing the impact of an out of control vehicle comprising:

a) a generally rectangular base;

b) a lower layer of vehicle tires mounted on the base and in side by side substantially touching relationship arranged in a pair of adjacent rows, the tires of one of the rows being offset longitudinally with respect to the tires in the other of the rows;

c) a lower spacer sheet of substantially the same dimensional configuration as the base plate, the lower sheet being mounted atop the tires of the lower layer;

d) a second layer of tires mounted on the lower sheet and also in side by side substantially touching relationship arranged in a pair of adjacent rows, the tires of a first of the rows being offset longitudinally with respect to the tires in a second of the rows, the tires of the first row being substantially directly above and longitudinally offset with respect to the tires of the one row;

e) a second spacer sheet of substantially the same dimensional configuration as the base plate, the second sheet being mounted atop the second layer;

f) a third layer of tires mounted on the second sheet and arranged in rows corresponding to the lower layer;

g) a third spacer sheet mounted atop the third layer;

h) a fourth layer of tires mounted atop the third layer and arranged in rows corresponding to the second layer;

i) a fourth sheet mounted atop the fourth layer; and, j) tie means connecting the sheets, the tires and the base together.

23. The barrier module of claim 22 wherein the base is a steel plate.

24. The barrier module of claim 22 wherein the base is a sheet of expanded steel.

25. The barrier module of claim 22 wherein the tie means comprises cables.

26. The barrier module of claim 22 wherein the tie means comprises rods.

27. A method of providing and maintaining a racetrack crash barrier comprising:

a) providing a ring of barrier support material around a racetrack with ring and crash barrier modules to be mounted on the material to provide module moving impact resistance to a possible impact of maximum anticipated force by a race vehicle;

b) providing a plurality of the crash barrier modules each having a longitudinal dimension, positioning the modules on said material in end to end relationship to form a barrier ring circumscribing a racetrack; and, c) providing a repair module of lesser longitudinal dimension than the modules of the ring whereby upon module displacing impact, the barrier ring may be quickly restored to an operative condition by removing an impacted module and replacing it with the repair module.

28. In combination:

a) a plurality of crash barrier modules;

b) a motor vehicle race track having a travel surface;

c) the modules being in longitudinally aligned relationship along a marginal portion of at least a section of the perimeter of the track travel surface, at least certain of the modules being free of force transmitting interconnections such that each such certain module is moveable relative to adjacent modules without transmitting forces to the adjacent modules when impacted by a motor vehicle departing from an intended route of travel over the travel surface; and, d) each of said certain barrier modules comprising:

i) a base including a top surface for surface extension alignment with the travel surface;

ii) an impact absorbent structure mounted on and fixed to the base for energy absorption upon impact by a vehicle;

iii) the base including a bottom slide surface for frictional resistance to movement over a barrier support surface adjacent to the travel surface, such movement occurring upon vehicle impact with the module; and, iv) the energy absorption capacity of the module including energy absorbed by the structure being adequate normally to avoid a vehicle operator fatality by absorbing the energy of a worst condition impact by a vehicle of a type intended to traverse the travel surface.

29. The combination of claim 28 wherein the modules form a ring circumscribing the track travel surface.

30. The combination of claim 29 wherein there are inner and outer module rings with the inner ring circumscribing the track travel surface and the outer ring circumscribing the inner ring in closely spaced relationship whereby on severe vehicle impact with a barrier module of the inner ring the impacted module will be slidingly driven into at least one module of the outer ring.

* * * * *